US011325177B2

(12) United States Patent
Long et al.

(10) Patent No.: US 11,325,177 B2
(45) Date of Patent: May 10, 2022

(54) DIE ADJUSTMENT MECHANISM

(71) Applicant: OMS MACHINERY CO., LTD., Guangdong (CN)

(72) Inventors: Xiaobin Long, Zhongshan (CN); Haifeng Hu, Zhongshan (CN); Chuan Long, Zhongshan (CN); Yang Shi, Zhongshan (CN)

(73) Assignee: OMS MACHINERY CO., LTD., Guangdong (CN)

( * ) Notice: Subject to any disclaimer, the term of this patent is extended or adjusted under 35 U.S.C. 154(b) by 534 days.

(21) Appl. No.: 16/317,013

(22) PCT Filed: Nov. 30, 2017

(86) PCT No.: PCT/CN2017/113736
§ 371 (c)(1),
(2) Date: Jan. 10, 2019

(87) PCT Pub. No.: WO2019/015204
PCT Pub. Date: Jan. 24, 2019

(65) Prior Publication Data

US 2019/0291162 A1 Sep. 26, 2019

(30) Foreign Application Priority Data

Jul. 19, 2017 (CN) ..... 201710590962.0

(51) Int. Cl.
*B21D 37/10* (2006.01)
*B21D 35/00* (2006.01)

(52) U.S. Cl.
CPC ..... *B21D 37/10* (2013.01); *B21D 35/002* (2013.01)

(58) Field of Classification Search
CPC ..... B21D 37/10; B21D 37/14; B21D 35/002; B21D 5/0236; B21D 5/0254; B21D 5/04;
(Continued)

(56) References Cited

U.S. PATENT DOCUMENTS 5,927,135 A * 7/1999 Kutschker ..... B21D 5/042 72/319

FOREIGN PATENT DOCUMENTS

CN 202516938 U 11/2012
CN 203002925 U 6/2013
(Continued)

OTHER PUBLICATIONS

Apr. 26, 2018 International Search Report issued in International Patent Application No. PCT/CN2017/113736.
(Continued)

*Primary Examiner* — Teresa M Ekiert
(74) *Attorney, Agent, or Firm* — Oliff PLC

(57) ABSTRACT

A die adjustment mechanism, includes a base, the base is provided with a die that can apply pressure on the workpiece. The die includes multiple modules arranged sequentially and capable of sliding laterally relative to the base. The base is further provided with a slide rest/slide rests capable of sliding laterally relative to the base. Each slide rest is provided with a shifting fork which can be clamped with a module or can be clamped between two adjacent modules. Each slide rest is provided with a drive component capable of driving the shifting fork to be clamped with the module or be clamped between the two adjacent modules. Using this mechanism, bending and pressing of multiple sides of the metal plate can be completed by the same machine and the production efficiency is greatly improved.

5 Claims, 4 Drawing Sheets

(58) Field of Classification Search
CPC ..... B21D 5/042; B21D 5/045; B21D 5/047; B21D 37/02; B21D 37/04; B21D 37/06; B21D 43/003; B30B 15/026; B30B 15/028; B30B 15/02
See application file for complete search history.

(56) References Cited

FOREIGN PATENT DOCUMENTS

| | | | | | |
|---|---|---|---|---|---|
| CN | 103962457 | A | | 8/2014 | |
| CN | 204486585 | U | | 7/2015 | |
| CN | 107282777 | A | | 10/2017 | |
| DE | 3726572 | A1 | | 2/1989 | |
| JP | 61103626 | A | * | 5/1986 | ..... B21D 5/04 |

OTHER PUBLICATIONS

Apr. 26, 2018 Written Opinion of the International Searching Authority issued in International Patent Application No. PCT/CN2017/113736.

* cited by examiner

DIE ADJUSTMENT MECHANISM

TECHNICAL FIELD

The present invention relates to a die adjustment mechanism.

BACKGROUND ART

During a manufacturing process of sheet metal, the sides of the metal plates often need to be bent and pressed. For example, for a quadrilateral metal plate, when one side of the metal plate is bent and pressed, the width of the metal plate is narrowed. If the adjacent side of the bent side is bent and pressed by the bending machine, since the width of the die is not changed, the portion where the original bending is completed is pressed again, thereby causing damage to the portion of the original bent side. The traditional machining process is to change the workpiece to another bending machine with a smaller die width for subsequent processing after bending and pressing of one side completed. Therefore, the traditional processing steps are complicated and the production efficiency is low.

Therefore, the present invention targets at the above deficiencies.

SUMMARY OF THE INVENTION

An objective of the present invention is to overcome the deficiencies of the prior art and to provide a die adjustment mechanism having a simple structure. By adopting the die adjustment mechanism, multiple sides of the metal plate can be bent and pressed by the same bending machine, and the production efficiency is greatly improved. The present invention is implemented according to the following technical solutions: A die adjustment mechanism, comprising a base 1, wherein the base 1 is provided with a die 2 that can apply pressure on the workpiece, the die 2 includes multiple modules 21 that can be arranged sequentially and can slide laterally relative to the base 1; the base 1 is further provided with a slide rest 3/slide rests 3 that can slide laterally relative to the base 1; each slide rest 3 is provided with a shifting fork 4 which can be clamped with a module 21 or can be clamped between two adjacent modules 21; each slide rest 3 is provided with a drive component 5 that can drive the shifting fork 4 to be clamped with the module 21 or be clamped between the two adjacent modules 21.

In the die adjustment mechanism, the shifting fork 4 and the slide rest 3 are hinged by a hinge shaft 6, the drive component 5 includes a vertical strip hole 51 provided on the slide rest 3, the shifting fork 4 is provided with an inclined strip hole 52; a lateral pushing shaft 53 penetrates through the vertical strip hole 51 and the inclined strip hole 52, and the lateral pushing shaft 53 can slide along the vertical strip hole 51 and cooperates with the hole wall of the inclined strip hole 52 during sliding to push the shifting fork 4 to rotate relative to the slide rest 3; the slide rest 3 is provided with a pushing member 54 used to push the pushing shaft 53 to slide along the vertical strip hole 51.

In the die adjustment mechanism, the shifting fork 4 is provided with a clamping slot 7; after the shifting fork 5 rotates relative to the slide rest 3, the module 21 can be clamped into the clamping slot 7.

In the die adjustment mechanism, the shifting fork 4 is provided in an inclined manner and is connected to the slide rest 3 in a slidable manner; the drive component 5 includes a drive cylinder 55 that is provided on the slide rest 3 and capable of driving the shifting fork 4 to slide in an inclined manner relative to the slide rest 3 to be clamped with the module 21 or clamped between two adjacent modules 21.

In the die adjustment mechanism, there are two slide rests 3, two shifting forks 4, and two drive components 5.

Compared with the prior art, the present invention has the following advantages.

1. When the present invention is operating, the slide rest is driven to slide laterally on the base; when the slide rest slides to a required position, the drive component drives the shifting fork to move relative to the slide rest so that the shifting fork is clamped with the module or is clamped between two adjacent modules correspondingly; subsequently, the slide rest is driven again to slide laterally relative to the base. During the sliding of the slide rest, the shifting fork can apply a lateral pushing force on the module of one side, so as to push the module to slide relative to the base; therefore, multiple modules can be separated, so that the required width of the die can be changed, and the width of the die can be freely adjusted. Therefore, the more the modules pushed outward by the shifting fork, the narrower the width of the die composed by the left modules; while the less modules pushed outward by the shifting fork, the wider the die composed by the left modules. Therefore, when the width of the workpiece changes during a machining process, actions of the slide rest and the shifting fork can be used to adjust the width of the die, so that the width of the die is adapted to that of the workpiece during actual machining. Therefore, bending and pressing of multiple sides of the metal plate can be completed by the same machine and the production efficiency is greatly improved.
2. The shifting fork and the slide rest of the present invention are hinged by a hinge shaft/hinge shafts; during the process of driving the pushing shaft by the pushing member, the pushing shaft slides along the vertical strip hole respectively; meanwhile, the pushing shaft cooperates with the hole wall of the inclined strip hole so as to apply a pushing force on the shifting fork. Therefore, the shifting fork rotates relative to the slide rest by using a hinge shaft/hinge shafts. Therefore, when the shifting fork is required to move the module to one side, the shifting fork is rotated to a position that can be clamped with the module or clamped between two adjacent modules. When the die needs to compress the workpiece without adjusting the width of the die by the shifting fork, the shifting fork rotates to a position separated from the module. The entire structure is cleverly designed and the structure is simple.
3. The invention has a simple structure, can greatly improve productivity, and is suitable for popularization and application.

DETAILED DESCRIPTION OF THE INVENTION

Figure 1:
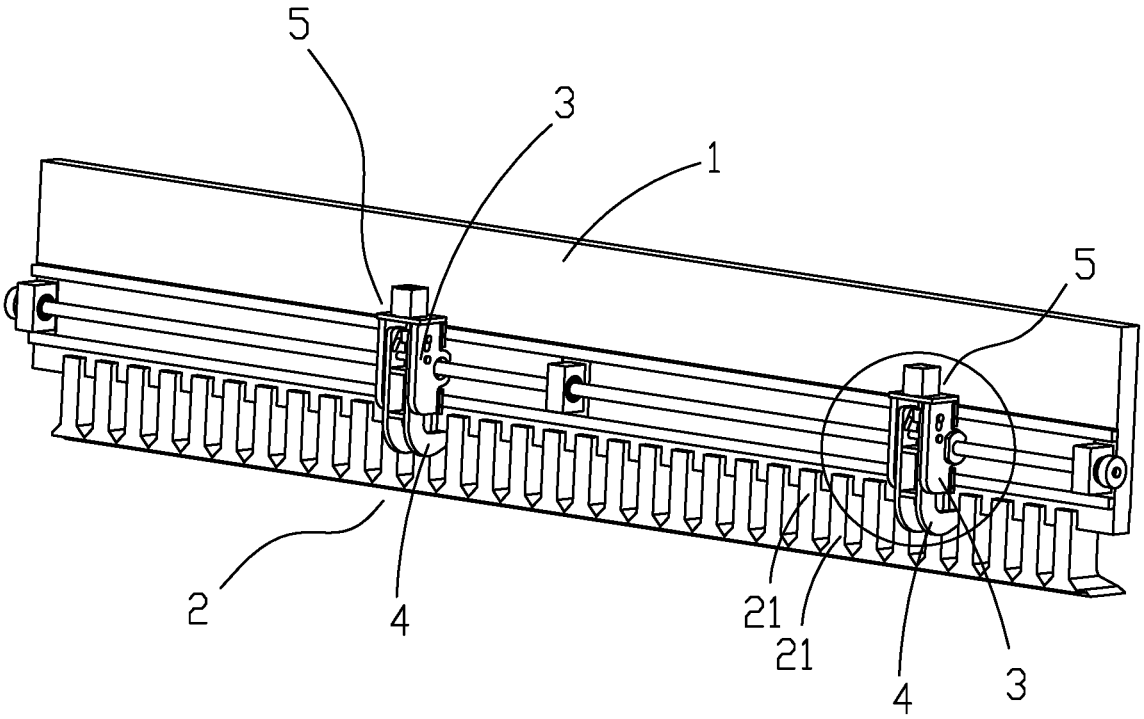
FIG. 1 is a perspective view of the first embodiment of the present invention.

The present invention is further described below with reference to the accompanying drawings:

Embodiment 1

As shown in FIG. 1 to FIG. 5, a die adjustment mechanism comprises a base 1, where the base 1 is provided with a die 2 that can apply pressure on the workpiece; the die 2 includes multiple modules 21 arranged sequentially and capable of sliding laterally relative to the base 1; the base 1 is further provided with a slide rest 3/slide rests 3 capable of sliding laterally relative to the base 1; each slide rest 3 is provided with a shifting fork 4 which can be clamped with a module 21 or can be clamped between two adjacent modules 21; the slide rest 3 is provided with a drive component 5 capable of driving the shifting fork 4 to be clamped with the module 21 or be clamped between the two modules 21. The lateral sliding of the slide rest 3 may be driven by a ball screw or other transmission mechanisms.

Figure 2:
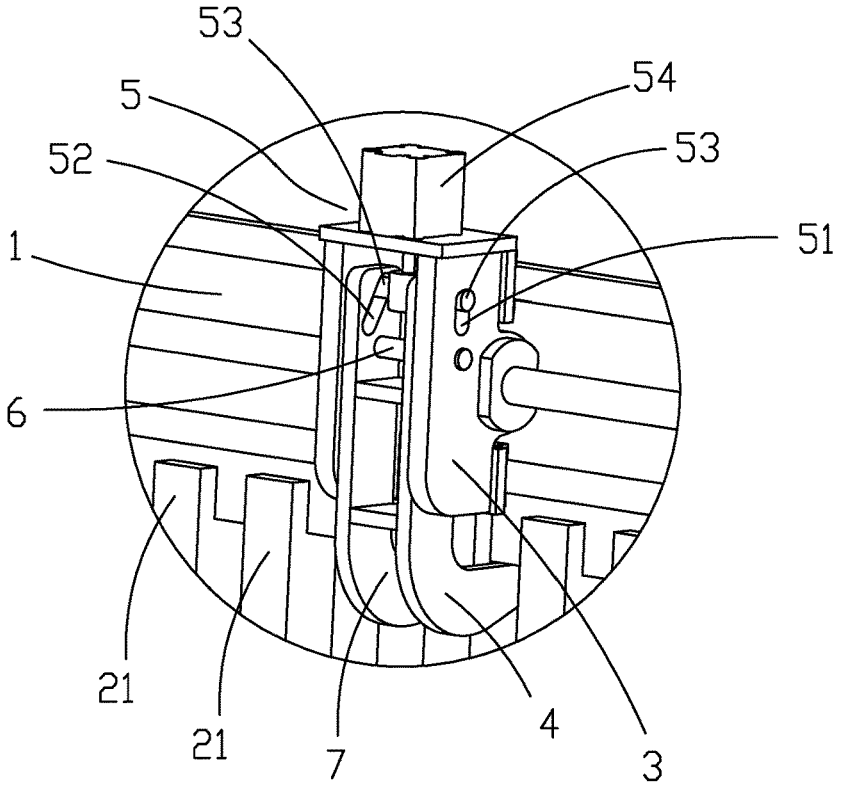
FIG. 2 is an enlarged view of the portion A in FIG. 1.
Figure 5:
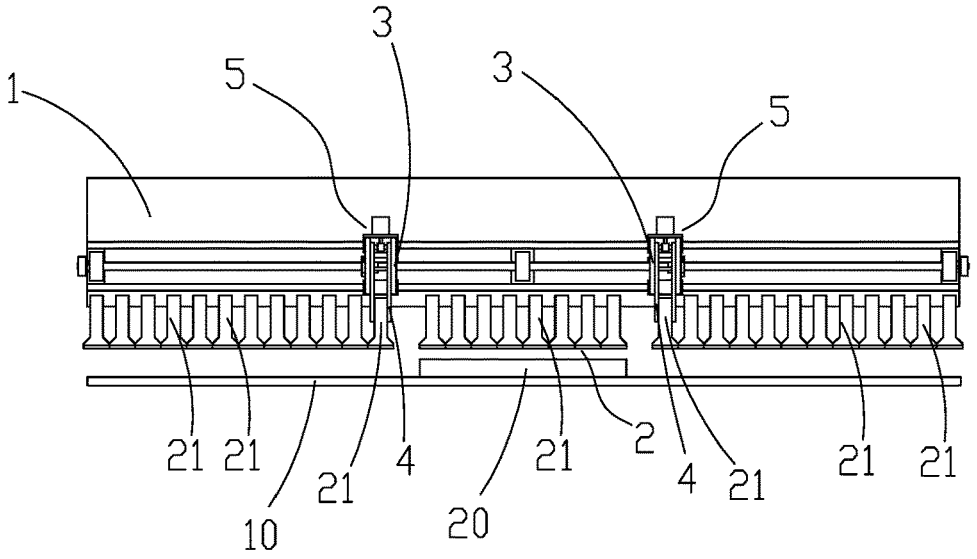
FIG. 5 is a schematic diagram in the operation of the first embodiment of the present invention.

As shown in FIG. 1, FIG. 2, and FIG. 5, when the die 2 cooperates with the lower die table 10 to press the workpiece 20, the slide rest 3 is/the slide rests 3 are driven to slide laterally on the base 1; when the slide rest 3 slides to a required position/the slide rests 3 slide to required position correspondingly, the drive component 5 drives the shifting fork 4 to move relative to the slide rest 3 so that the shifting fork 4 is clamped with the module 21 or the shifting fork 4 is clamped between two adjacent modules 21 respectively; subsequently, the slide rest 3 is/the slide rests 3 are driven again to slide laterally relative to the base 1. During the sliding of the slide rest 3, the shifting fork 4 can apply a lateral pushing force on the module 21 of one side respectively, so as to push the module 21/modules 21 to slide relative to the base 1; therefore, multiple modules 21 can be separated, so that the required width of the die 2 can be changed, and the width of the die 2 can be freely adjusted. Therefore, the more the modules 21 pushed outward by the shifting fork 4/the shifting forks 4, the narrower the width of the die 2 composed by the left modules 21; the less the modules 21 pushed outward by the shifting fork 4/the shifting forks, the wider the die 2 composed by the left modules 21. Therefore, when the width of the workpiece 20 changes during the machining process, the width of the die 2 may be adjusted by actions of the slide rest 3/the slide rests 3 and the shifting fork 4/the shifting forks 4, so that the width of the die 2 is adapted to that of the workpiece 20 during actual machining. When the width of the die 2 is adjusted appropriately, the base 1 approaches the lower die table 10, so as to drive the die 2 to approach the lower die table 10 and perform pressing on the workpiece 20. Therefore, bending and pressing of multiple sides of a metal plate can be completed by one same machine and the production efficiency is greatly improved.

Figure 3:
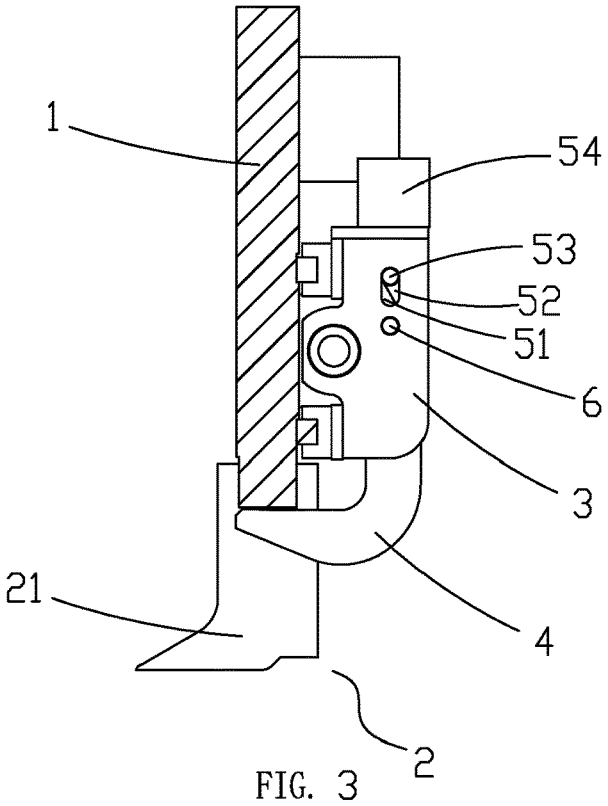
FIG. 3 is a schematic diagram of components of the first embodiment of the present invention.
Figure 4:
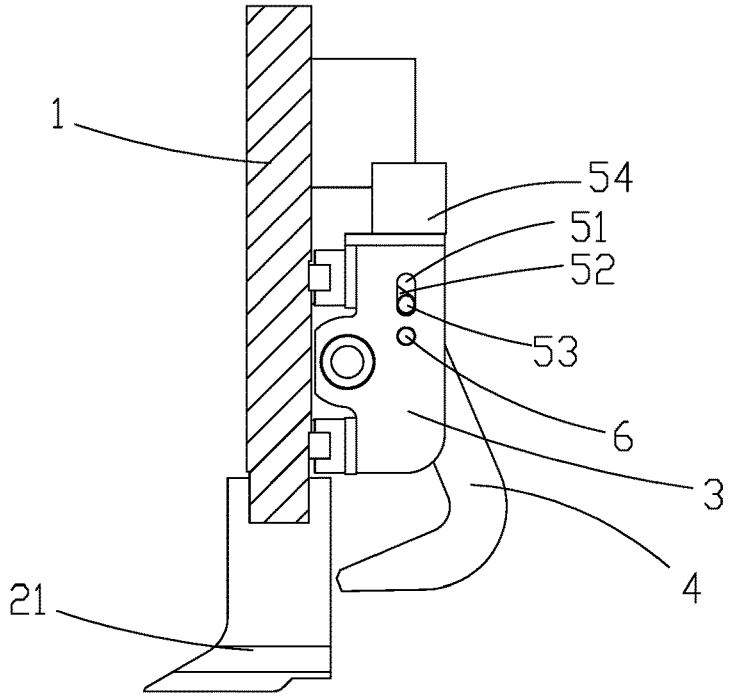
FIG. 4 is another schematic diagram of components of the first Embodiment of the present invention.

As shown in FIG. 2 to FIG. 4, the shifting fork 4 and the slide rest 3 are hinged by a hinge shaft 6 respectively. Each drive component 5 includes a vertical strip hole 51 provided on the slide rest 3, the shifting fork 4 is provided with an inclined strip hole 52, a lateral pushing shaft 53 penetrates through the vertical strip hole 51 and the inclined strip hole 52, and the lateral pushing shaft 53 can slide along the vertical strip hole 51 and cooperates with the hole wall of the inclined strip hole 52 during sliding to push the shifting fork 4 to rotate relative to the slide rest 3; each slide rest 3 is provided with a pushing member 54 used to push the pushing shaft 53 to slide along the vertical strip hole 51 respectively. The pushing member 4 shown may be a cylinder, a ball screw or a hydraulic cylinder and the like.

As shown in FIG. 2 to FIG. 4, during the process of driving the pushing shaft 53 by the pushing member 54, the pushing shaft 53 slides along the vertical strip hole 51; meanwhile, the pushing shaft 53 cooperates with the hole wall of the inclined strip hole 52 so as to apply a pushing force on the shifting fork 4, therefore, the shifting fork 4 rotates relative to the slide rest 3 by using the hinge shaft 6 correspondingly. So that, when the shifting fork 4 is required to move the module 21 to one side, the shifting fork 4 is rotated to be clamped with the module 21 or is rotated to a position, as shown in FIG. 3, clamped between two adjacent modules 21; when the die 2 needs to compress a workpiece 20 without adjusting the width of the die 2 by the shifting fork 4, the shifting fork 4 rotates to a position separated from the module 21/modules 21, as shown in FIG. 4. The entire structure is cleverly designed and the structure is simple.

As shown in FIG. 1, each shifting fork 4 is provided with a clamping slot 7; after the shifting fork 5 rotates relative to the slide rest 3 respectively, a module 21 can be clamped into the clamping slot 7.

As shown in FIG. 1 and FIG. 5, there are two slide rests 3, two shifting forks 4, and two drive components 5. Therefore, the width of the die 2 can be quickly and freely adjusted, and the production efficiency is greatly improved.

Embodiment 2

Figure 6:
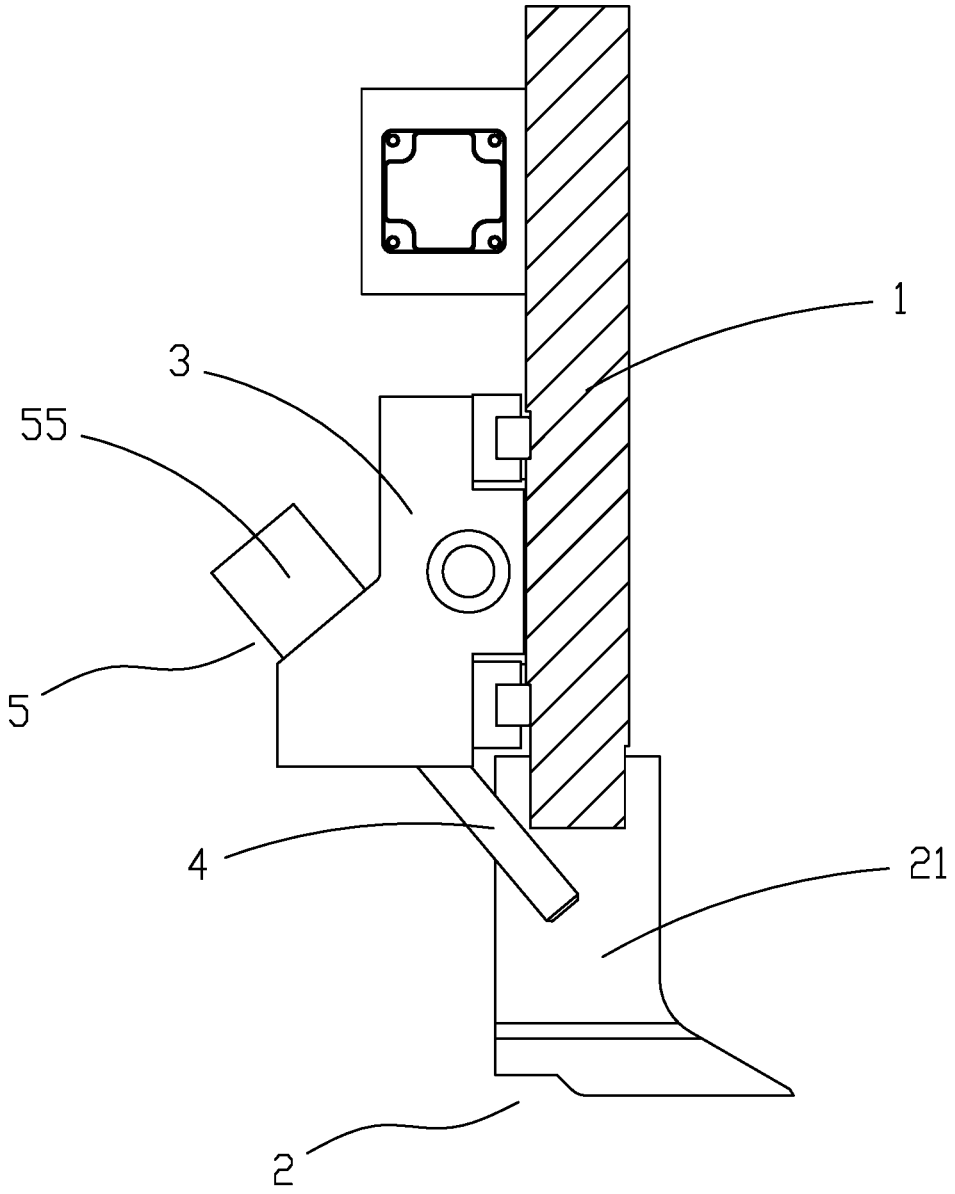
FIG. 6 is a schematic diagram of the second embodiment of the present invention.

As shown in FIG. 6, embodiment 1 differs from embodiment 2 in that:

The shifting fork 4 is provided in an inclined manner and is connected to the slide rest 3 respectively in a slidable manner; the drive component 5 includes a drive cylinder 55 that is provided on the slide rest 3 and can drive the shifting fork 4 to slide in an inclined manner relative to the slide rest 3 to be clamped with a module 21 or clamp between two adjacent modules 21 correspondingly. When the width of the die 2 needs to be adjusted, the drive cylinder 55 drives the shifting fork 4 to slide in an inclined manner so as to be clamped with the module 21 or clamped between two adjacent modules 21, and subsequently, the slide rest 3 slides laterally. The entire structure is simple and reliable, and operates stably.

What is claimed is:

1. A die adjustment mechanism comprising:

a base provided with:

a die that is configured to apply pressure on a workpiece, the die including multiple modules which are arranged sequentially and capable of sliding laterally relative to the base, and a slide rest capable of sliding laterally relative to the base, the slide rest being provided with:

a shifting fork which is hinged to the slide rest by a hinge shaft, the shifting fork being configured to be clamped: (i) with one module of the multiple modules or (ii) between two adjacent modules of the multiple modules, the shifting fork including at least one clamping slot, a drive component capable of driving the shifting fork to be clamped with the one module or be clamped between the two adjacent modules, the drive component including a lateral pushing shaft that penetrates through: (a) a vertical strip hole formed in the slide rest, and (b) an inclined strip hole formed in the shifting fork, the lateral pushing shaft being configured to slide along the vertical strip hole and cooperate with a hole wall of the inclined strip hole during sliding to push the shifting fork to rotate relative to the slide rest, and a pushing member configured to push the lateral pushing shaft to slide along the vertical strip hole, wherein the one module or the adjacent modules are configured to be correspondingly clamped into the at least one clamping slot of the shifting fork after the shifting fork rotates relative to the slide rest.

2. The die adjustment mechanism according to claim 1, wherein:

the shifting fork is provided in an inclined manner and is connected to the slide rest in a slidable manner; and the drive component includes a drive cylinder that is provided on the slide rest and is capable of driving the shifting fork to slide in an inclined manner relative to the slide rest to be clamped with the one module or clamped between the two adjacent modules.

3. The die adjustment mechanism according to claim 1, further comprising a second slide rest, a second shifting fork, and a second drive component.

4. A die adjustment mechanism comprising:

a base provided with:

a die that is configured to apply pressure on a workpiece, the die including multiple modules which are arranged sequentially and capable of sliding laterally relative to the base, and a slide rest capable of sliding laterally relative to the base, the slide rest being provided with:

a shifting fork which is configured to be clamped: (i) with one module of the multiple modules or (ii) between two adjacent modules of the multiple modules, and a drive component capable of driving the shifting fork to be clamped with the one module or be clamped between the two adjacent modules, wherein:

the shifting fork is provided in an inclined manner and is connected to the slide rest in a slidable manner; and the drive component includes a drive cylinder that is provided on the slide rest and is capable of driving the shifting fork to slide in an inclined manner relative to the slide rest to be clamped with the one module or clamped between the two adjacent modules.

5. The die adjustment mechanism according to claim 4, further comprising a second slide rest, a second shifting fork, and a second drive component.

* * * * *